US008726518B2

(12) United States Patent
Bruno

(10) Patent No.: US 8,726,518 B2
(45) Date of Patent: May 20, 2014

(54) SHAVING RAZORS AND CARTRIDGES

(75) Inventor: Michael Hal Bruno, Burlington, MA (US)

(73) Assignee: The Gillette Company, Boston, MA (US)

( * ) Notice: Subject to any disclaimer, the term of this patent is extended or adjusted under 35 U.S.C. 154(b) by 552 days.

(21) Appl. No.: 12/724,737

(22) Filed: Mar. 16, 2010

(65) Prior Publication Data

US 2011/0225828 A1 Sep. 22, 2011

(51) Int. Cl.

| | |
|---|---|
| ***B26B 19/42*** | (2006.01) |
| ***B26B 21/00*** | (2006.01) |
| ***B26B 21/40*** | (2006.01) |

(52) U.S. Cl.
USPC ..... 30/34.2; 30/50; 30/74.1; 30/77

(58) Field of Classification Search
USPC ..... D28/47; 30/34.2, 50, 59, 65, 74.1, 76, 30/77, 81–84
See application file for complete search history.

(56) References Cited

U.S. PATENT DOCUMENTS

| | | | | | |
|---|---|---|---|---|---|
| 3,138,865 | A | * | 6/1964 | Meyer | 30/34.2 |
| 3,871,073 | A | * | 3/1975 | Nissen et al. | 30/34.2 |
| 4,044,463 | A | | 8/1977 | Tietjens | |
| 4,189,832 | A | * | 2/1980 | Harper et al. | 30/34.2 |
| 4,504,998 | A | * | 3/1985 | Price et al. | 132/313 |
| 4,535,537 | A | | 8/1985 | Ferraro et al. | |
| 4,741,103 | A | | 5/1988 | Hultman | |
| 4,854,043 | A | | 8/1989 | Chen | |
| 4,998,347 | A | | 3/1991 | Schächter | |
| 5,031,316 | A | | 7/1991 | Oldroyd | |
| 5,063,667 | A | | 11/1991 | Jacobson | |
| 5,092,042 | A | * | 3/1992 | Miller et al. | 30/77 |
| 5,113,585 | A | * | 5/1992 | Rogers et al. | 30/50 |
| 5,185,927 | A | | 2/1993 | Rivers | |
| 5,191,712 | A | | 3/1993 | Crook et al. | |
| 5,313,705 | A | | 5/1994 | Rivers et al. | |
| 5,365,665 | A | | 11/1994 | Coffin | |
| 5,388,332 | A | | 2/1995 | Oldroyd | |

(Continued)

FOREIGN PATENT DOCUMENTS

| | | |
|---|---|---|
| WO | WO 92/06827 | 4/1992 |
| WO | WO 96/24469 | 8/1996 |

(Continued)

OTHER PUBLICATIONS

PCT International Search Report with Written Opinion in corresponding international application PCT/US2011/027564 dated Jun. 7, 2011.

*Primary Examiner* — Jason Daniel Prone
(74) *Attorney, Agent, or Firm* — John M. Lipchitz; Kevin C. Johnson; Steven W. Miller

(57) ABSTRACT

A shaving system has a cap, a skin-engaging member, at least one blade between the skin engaging member and the cap, and a guard bar between the skin engaging member and the blade. The guard bar has a first set of spaced apart projections offset from a second set of spaced apart projections in a first direction parallel to the blade and in a second direction transverse to the blade. The first set of projections and the second set of projections define a plurality of open channels extending transverse to the blade. The open channels have a width of about 0.20 mm to about 0.50 mm.

18 Claims, 5 Drawing Sheets

(56) References Cited

U.S. PATENT DOCUMENTS

| | | | | | |
|---|---|---|---|---|---|
| 5,454,164 | A | * | 10/1995 | Yin et al. | 30/50 |
| 5,475,923 | A | | 12/1995 | Ferraro | |
| 5,546,660 | A | * | 8/1996 | Burout et al. | 30/50 |
| 5,590,468 | A | | 1/1997 | Prochaska | |
| 5,671,534 | A | * | 9/1997 | Mayerovitch | 30/50 |
| 5,678,311 | A | * | 10/1997 | Avidor | 30/34.2 |
| 5,802,721 | A | | 9/1998 | Wain et al. | |
| 5,915,791 | A | * | 6/1999 | Yin et al. | 30/41 |
| 5,933,959 | A | * | 8/1999 | Sferruzza, Jr. | 30/34.2 |
| 5,953,819 | A | | 9/1999 | Simms et al. | |
| D415,315 | S | * | 10/1999 | Swanson et al. | D28/47 |
| D424,744 | S | * | 5/2000 | Coffin et al. | D28/47 |
| 6,085,421 | A | | 7/2000 | Jorna et al. | |
| 6,167,625 | B1 | * | 1/2001 | King et al. | 30/34.2 |
| 6,233,829 | B1 | | 5/2001 | Oglesby et al. | |
| 6,243,951 | B1 | | 6/2001 | Oldroyd | |
| 6,298,557 | B1 | | 10/2001 | Gilder | |
| 6,442,840 | B2 | * | 9/2002 | Zucker | 30/34.2 |
| 6,516,518 | B1 | | 2/2003 | Garraway et al. | |
| D472,017 | S | * | 3/2003 | Kite et al. | D28/47 |
| 6,550,141 | B1 | | 4/2003 | Rivers et al. | |
| 6,675,479 | B1 | * | 1/2004 | Walker et al. | 30/34.2 |
| 6,772,523 | B1 | * | 8/2004 | Richard et al. | 30/50 |
| 6,941,659 | B2 | * | 9/2005 | Gilder | 30/34.2 |
| 7,043,840 | B2 | * | 5/2006 | Walker et al. | 30/34.2 |
| D524,483 | S | * | 7/2006 | Bunnell et al. | D28/47 |
| D524,986 | S | * | 7/2006 | Prudden, Jr. | D28/47 |
| D526,089 | S | * | 8/2006 | Fischer et al. | D28/47 |
| 7,111,401 | B2 | | 9/2006 | Richard | |
| 7,200,937 | B2 | * | 4/2007 | Richard et al. | 30/50 |
| D563,044 | S | * | 2/2008 | Ramm | D28/47 |
| 7,370,419 | B2 | * | 5/2008 | Coffin et al. | 30/50 |
| D604,904 | S | * | 11/2009 | Watson | D28/47 |
| D617,946 | S | * | 6/2010 | Lukan et al. | D28/47 |
| D617,947 | S | * | 6/2010 | Lukan et al. | D28/47 |
| D617,948 | S | * | 6/2010 | Lukan et al. | D28/47 |
| D617,949 | S | * | 6/2010 | Lukan et al. | D28/47 |
| D622,904 | S | * | 8/2010 | Kinard et al. | D28/47 |
| D627,100 | S | * | 11/2010 | Kinard et al. | D28/47 |
| D627,101 | S | * | 11/2010 | Kinard et al. | D28/47 |
| D627,518 | S | * | 11/2010 | Kinard et al. | D28/47 |
| D631,198 | S | * | 1/2011 | Adams et al. | D28/47 |
| D636,532 | S | * | 4/2011 | Jessemey et al. | D28/47 |
| D640,415 | S | * | 6/2011 | Wonderley et al. | D28/47 |
| D643,976 | S | * | 8/2011 | Wonderley et al. | D28/47 |
| D643,977 | S | * | 8/2011 | Wonderley et al. | D28/47 |
| D648,076 | S | * | 11/2011 | Jessemey et al. | D28/47 |
| D653,395 | S | * | 1/2012 | Adams et al. | D28/47 |
| 8,186,062 | B2 | * | 5/2012 | Fischer et al. | 30/34.2 |
| D661,426 | S | * | 6/2012 | Wain et al. | D28/47 |
| 8,209,867 | B2 | * | 7/2012 | Clarke | 30/34.2 |
| 8,209,869 | B2 | * | 7/2012 | Royle | 30/50 |
| D665,130 | S | * | 8/2012 | Wain et al. | D28/47 |
| 2002/0095791 | A1 | * | 7/2002 | Pennella et al. | 30/50 |
| 2002/0184770 | A1 | * | 12/2002 | Peyser | 30/50 |
| 2003/0046817 | A1 | * | 3/2003 | Coffin | 30/50 |
| 2003/0159291 | A1 | | 8/2003 | Clark | |
| 2005/0246898 | A1 | | 11/2005 | Gilder | |
| 2006/0277759 | A1 | | 12/2006 | Follo | |
| 2008/0034590 | A1 | * | 2/2008 | Prudden et al. | 30/34.2 |
| 2008/0060668 | A1 | * | 3/2008 | Legassie | 132/218 |
| 2008/0283078 | A1 | * | 11/2008 | Dumler et al. | 132/218 |
| 2009/0049695 | A1 | | 2/2009 | Keene et al. | |
| 2009/0071006 | A1 | * | 3/2009 | Bruno | 30/34.2 |
| 2009/0071007 | A1 | * | 3/2009 | Bruno | 30/34.2 |
| 2009/0071009 | A1 | * | 3/2009 | Hamburg et al. | 30/41.6 |
| 2009/0293281 | A1 | * | 12/2009 | Bruno | 30/50 |
| 2010/0083510 | A1 | | 4/2010 | Clarke | |
| 2010/0288294 | A1 | | 11/2010 | Fathallah et al. | |
| 2012/0144675 | A1 | * | 6/2012 | Keene et al. | 30/34.2 |
| 2012/0174409 | A1 | * | 7/2012 | Lelieveld | 30/34.2 |
| 2012/0233863 | A1 | * | 9/2012 | Clarke | 30/34.2 |

FOREIGN PATENT DOCUMENTS

| | | | | |
|---|---|---|---|---|
| WO | WO 97/25190 | | | 7/1997 |
| WO | WO 98/05479 | | | 2/1998 |
| WO | WO 00/37227 | | | 6/2000 |
| WO | WO 2004/069496 | A1 | | 8/2004 |
| WO | WO 2009034538 | A1 | * | 3/2009 |
| WO | WO 2009034539 | A1 | * | 3/2009 |
| WO | WO 2009146230 | A1 | * | 12/2009 |

* cited by examiner

SHAVING RAZORS AND CARTRIDGES

FIELD OF THE INVENTION

The present invention relates to shaving razors and more particularly to shaving systems having a guard bar to facilitate the alignment and passage of hair to a blade for efficient and effective shaving.

BACKGROUND OF THE INVENTION

In general, a cartridge of a shaving system has at least one blade with a cutting edge which is moved across the surface of the skin being shaved by means of a handle to which the cartridge is attached. The cartridge may be mounted detachably on the handle to enable the cartridge to be replaced by a fresh cartridge when the blade sharpness has diminished to an unsatisfactory level, or it may be attached permanently to the handle with the intention that the entire razor be discarded when the blade or blades have become dulled. Cartridges usually include a guard which contacts the skin in front of the blade(s) and a cap for contacting the skin behind the blade(s) during shaving. However, some products offer a guard that is adjacent to the blades, but is positioned on the handle instead on the cartridge or housing. The cap and guard may aid in establishing the so-called "shaving geometry", i.e., the parameters which determine the blade orientation and position relative to the skin during shaving, which in turn have a strong influence on the shaving performance and efficacy of the razor. The guard may include a generally rigid guard bar that may be formed integrally with the housing or platform structure which provides a support for the blades. Guards may include skin stretching elements made from various types of elastomeric materials that are intended to stretch the skin, but not align hair in front of the blade.

Hair growth varies greatly depending on the individual, as well as the area of the body being shaved. Typically short hairs are characterized as growth of approximately twenty-four hours. Standard shaving razor guards are able to cut short hairs rather effectively because the short hairs are generally stiff and are oriented generally perpendicular to the blade. As the hair grows longer it has a tendency to bend over and lay flat against the surface of the skin in an orientation that is more parallel to the blade. Standard shaving razor guards are not very effective due to the orientation of longer hairs because the blade will have the tendency to skive or cut the hair at an angle more parallel to the skin surface. Some hairs may lay flat such that the blade of the razor passes over the hairs without cutting them. The user often has to shave the same area repeatedly to cut hairs that were either uncut or not cut close enough to the skin surface, resulting in increased skin irritation.

SUMMARY OF THE INVENTION

In one aspect, the invention features, in general, a shaving system having a cap, a skin-engaging member, at least one blade between the skin engaging member and the cap, and a guard bar between the skin engaging member and the blade. The guard bar has a first set of spaced apart projections offset from a second set of spaced apart projections in a first direction parallel to the blade and in a second direction transverse to the blade. The first set of projections and the second set of projections define a plurality of open channels extending transverse to the blade. The open channels have a width of about 0.20 mm to about 0.50 mm. If, desired, particular embodiments may optionally include an elongated gap defined by a rear face of the skin engaging member and the first set of projections. The elongated gap extends parallel to the blade has a width of about 0.5 to about 1.5 mm.

In another aspect, the invention features, in general, a shaving cartridge having a housing with a cap and a guard bar. At least one blade is mounted to the housing between the cap and the guard bar. A skin-engaging member is mounted to the housing in front of the guard bar and a plurality of fingers project from the guard bar. The plurality of fingers are laterally spaced apart by a distance of about 0.6 mm to about 1.5 mm and are longitudinally spaced apart by a distance of about 0.05 mm to about 0.50 mm. If, desired, particular embodiments may optionally include the plurality of fingers defining a plurality of open channels extending transverse to the blade. The open channels have a width of about 0.20 mm to about 0.50 mm.

DETAILED DESCRIPTION OF THE INVENTION

Figure 1:
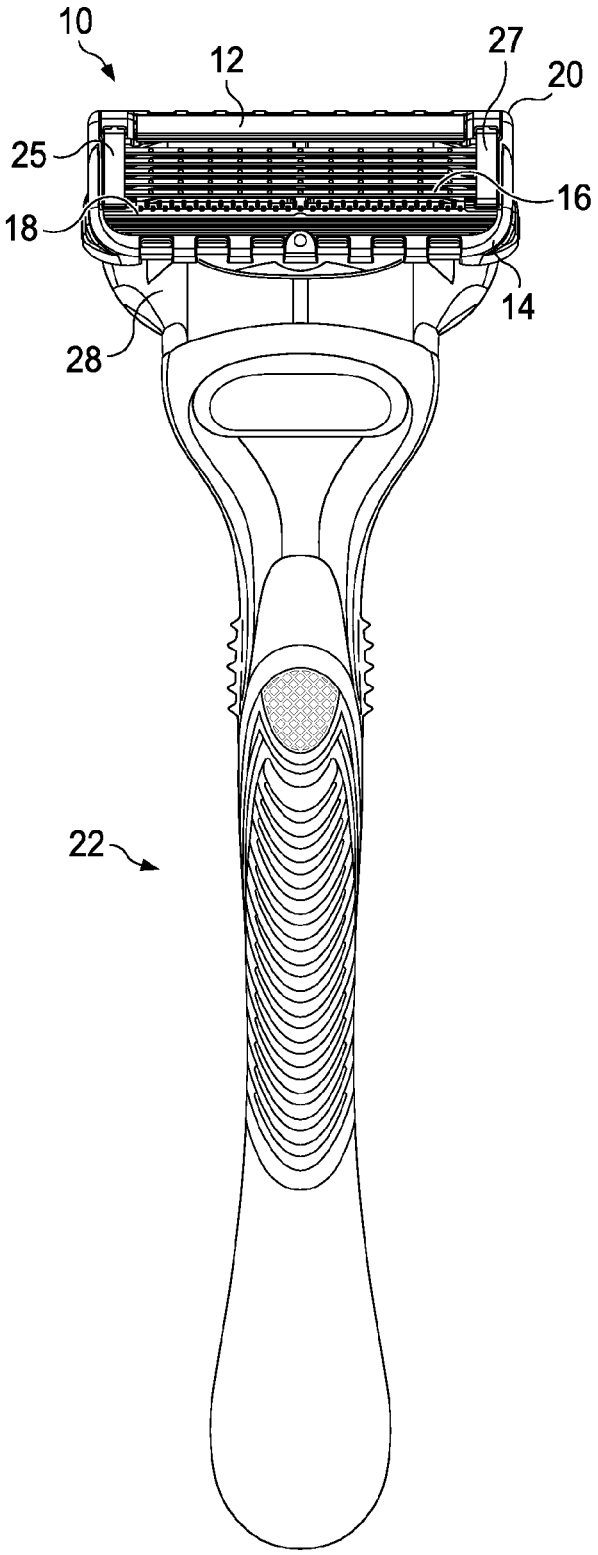
FIG. 1 is a top view of one possible embodiment of a shaving system having a handle.

Referring to FIG. 1, one embodiment of the present invention is shown illustrating a shaving system 10 having a cap 12, a skin-engaging member 14, at least one blade 16 between the skin-engaging member 14 and the cap 12. A guard bar 18 may be positioned between the skin engaging member 14 and the at least one blade 16. Although five blades 16 are shown, the shaving system 10 may have more or less blades 16 depending on the desired performance and cost of the shaving system 10. In certain embodiments, the blade 16 may be mounted to a plastic housing 20 and secured with at least one clip 25 and 27. Other assembly methods known to those skilled in the art may also be used to secure and/or mount the blade 16 to the housing 20 including, but not limited to, wire wrapping, cold forming, hot staking, insert molding, and adhesives.

The shaving system 10 may be pivotably and/or detachably mounted to a handle 22 (i.e., rotation of the housing 20 about an axis relative to the handle 22). A connector mechanism 28 may be used to releasably and/or pivotably connect the housing 20 to the handle 22. The cap 12, the skin-engaging member 14, and the guard bar 18 may be mounted to the housing 20. The skin-engaging member 14 may be directly or indirectly mounted the housing 20. For example, the skin-engaging member 14 may be directly mounted to the housing 20 using adhesives, clips, co-injection molding, or other assembly methods known to those skilled in the art. Alternatively, the skin-engaging member 14 may be directly mounted to the handle 22 and the handle 22 may be directly mounted to the housing 20. In this embodiment, the cap 12 and the blade 16 may be mounted to the housing 20 and the housing 20 may be replaced as the blades become too dull.

The guard bar 18 may extend parallel to the blade 16 and the skin-engaging member 14. The guard bar 18 may be joined to or integral with the housing 20. For example, the guard bar 18 may be injection molded as part of the housing 20. The guard bar 18 may also be insert molded or co-injection molded to the housing 20. Other assembly methods known to those skilled in the art may also be used to secure and/or mount the guard bar 18 to the housing 20 including, but not limited to, clips, snap fits, wire wrapping, cold forming, hot staking, and adhesives.

The housing 20 and/or guard bar 18 may be injection molded from a semi-rigid polymeric material having a Shore A hardness of about 50, 60, or 70 to about 90, 110, or 120. In certain embodiments the guard bar 18 may be molded from the same material as the housing 20, for example, Noryl™ (a blend of polyphenylene oxide (PPO) and polystyrene developed by General Electric Plastics, now SABIC Innovative Plastics). Alternatively, the housing 20 and/or the guard bar 18 may be machined from metals, such as stainless steel or aluminum. A metal or semi-rigid polymeric material may allow the housing 20 and/or the guard bar 18 to maintain a consistent geometry during shaving and improve alignment of hairs in front of the blade 16.

The cap 12 may movable or fixedly mounted to the housing 20 behind the blade 16. The cap may also be molded as part of the housing 20. In certain embodiments, the cap 12 may have a smooth surface and may provide one or more benefits, such as lubrication or moisturization to the skin by delivering one or more shaving aids behind the blade 16. The cap 12 may include a shaving aid such as a soap, for example, a poured or extruded soap. Soap-based compositions may be modified to increase hardness, wear resistance, lubricity and/or skin moisturizing and conditioning properties of the cap 12. Other materials may be used for the cap 12, such as a material comprising a mixture of a hydrophobic material and a water leachable hydrophilic polymeric material, as is known in the art and described in U.S. Pat. Nos. 5,113,585 and 5,454,164. The cap 12 may have sufficient wear resistance such that the cap 12 lasts for the intended life of the blade 16 (e.g., the blade 16 becomes dull).

Figure 2:
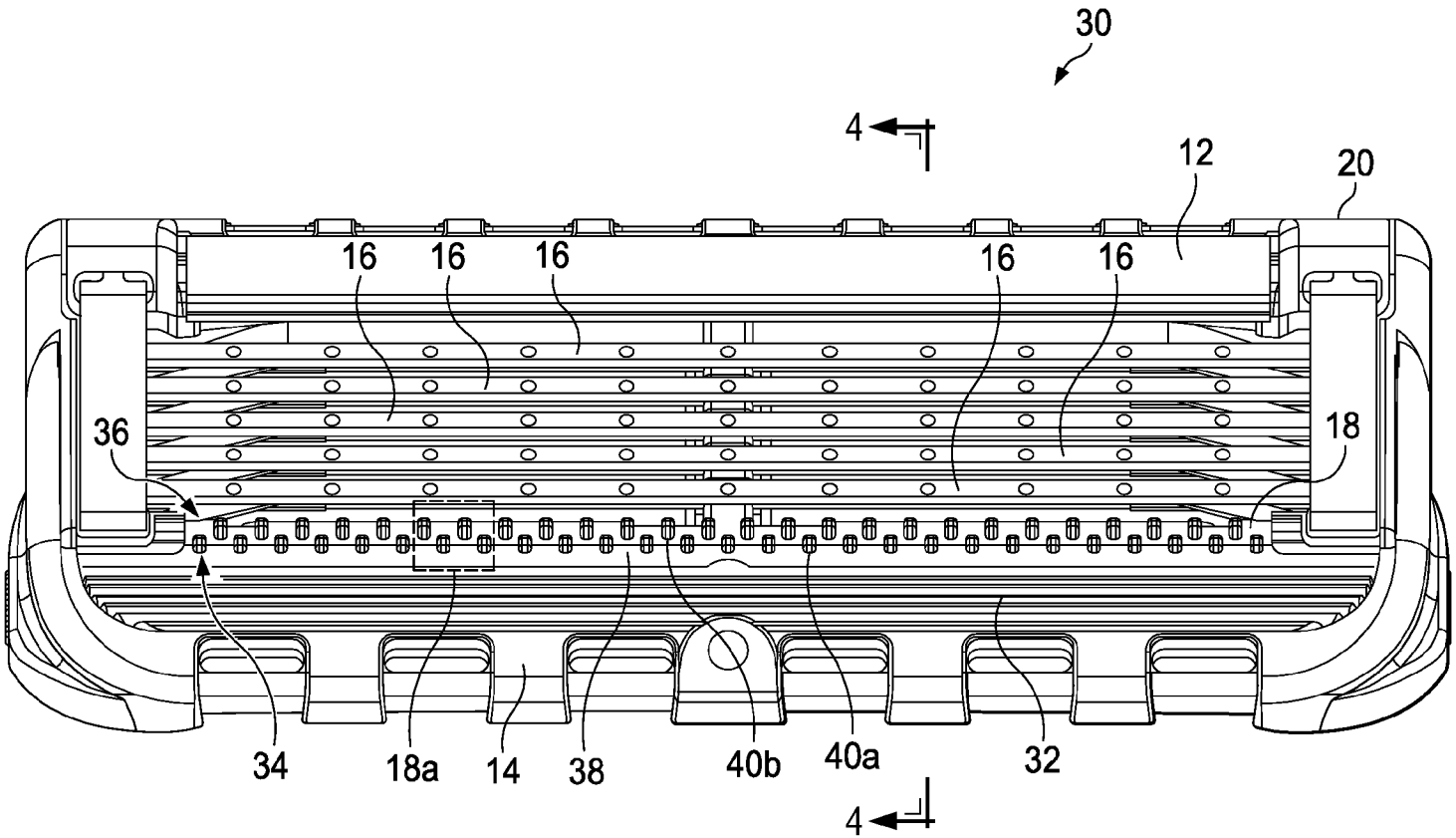
FIG. 2 is a top view of one possible embodiment of a shaving cartridge, which may be incorporated into the shaving system shown in FIG. 1.

Referring to FIG. 2, one possible embodiment of a shaving cartridge 30 is shown. The cartridge 30 may be mounted to the handle 22, as shown in FIG. 1. The shaving cartridge 30 may include the blade 16 mounted to the housing with a cap 12 behind the blade 16 and the guard bar 18 in front of the blade 16. The skin-engaging member 14 may be mounted to the housing 20 in front of the guard bar 18. The skin-engaging member 14 may include one or more skin engaging protrusions 32 that extend longitudinally along a length the housing 20 in front of the blade 16. Some of the skin engaging protrusions 32 may extend across the entire length housing 20 and/or along only a portion of the housing 20. The skin-engaging protrusion 32 (here a plurality of spaced apart fins) can have different sizes, shapes and geometries. In particular, the skin-engaging protrusion 32 can be in the form of nubs or fin segments that are spaced apart or interconnected. The skin-engaging protrusion 32 may also have different patterns or may be oriented at different angles with respect to the blade 16 (e.g., in zigzag, chevron, herringbone or checkerboard patterns). The skin-engaging protrusion 32 may also include an elastomeric substrate having a plurality of holes or other recessed patterns. The skin-engaging protrusion 32 can also take the form of spaced fin segments that are arranged in rows oriented generally parallel to the blades 16 or spaced fin segments that are arranged both parallel to and perpendicular to the blades 16.

In certain embodiments, the skin-engaging member 14 and/or the skin-engaging protrusion 32 may comprise a resilient material that flexes or bends under normal shaving conditions to facilitate the stretching of skin in front of the guard bar 18. For example, the skin-engaging member 14 the skin-engaging protrusion 32 may be molded from a polymeric material with a Shore A hardness of about 20, 30, or 40 to about 50, 60, or 70. The skin-engaging member 14 the skin-engaging protrusion 32 may be molded from a polymeric material with a Shore A hardness that is less than the Shore A hardness of the guard bar 18. A softer material (i.e., lower Shore A hardness) may enhance skin stretching, as well as provide a more pleasant tactile feel against the skin of the user during shaving. A softer material may also aid in masking the less pleasant feel of the blade 16 against the skin of the user during shaving. The skin-engaging member 14 the skin-engaging protrusion 32 may comprise thermoplastic elastomers (TPEs) or rubbers; examples may include, but are not limited to silicones, natural rubber, butyl rubber, nitrile rubber, styrene butadiene rubber, styrene butadiene styrene (SBS) TPEs, styrene ethylene butadiene styrene (SEBS) TPEs (e.g., TPEs supplied by Kraton Polymers), polyester TPEs (e.g., Hytrel®), polyamide TPEs (Pebax®), polyurethane TPEs, polyolefin based TPEs, and blends of any of these TPEs (e.g., polyester/SEBS blend). In certain embodiments, the skin-engaging member 14 may be molded from an elastomeric material, such as Kraiburg TC5GIL MS 34405 (KRAIBURG TPE GmbH & Co. KG of Waldkraiburg, Germany).

As will be described in greater detail below, the hardness of the guard bar 18 may provide for improved alignment of hairs during shaving and the softer skin-engaging member 14 may provide optimum skin stretching and tactile feel. However, skin-engaging member 14 and/or the skin engaging protrusion 32 are not limited to resilient materials. The skin-engaging member 14 and/or the skin engaging protrusion 32 may be rigid; for example, the engaging member 14 may be molded from the same material as previously described for the housing 20. For certain shaving systems, it may be desirable to mold the skin-engaging member 14 from the same material as the housing 20 to reduce manufacturing costs, but still provide sufficient skin stretching during shaving.

The guard bar 18 may have a first set of spaced apart projections 34 and a second set of spaced apart projections 36 that extend along the guard bar 18 and are positioned between the blade 16 and the skin engaging member 14 (e.g., the skin-engaging protrusion 32). Although only two sets of projections are shown, more than two sets of spaced apart projections 34 and 36 may be used to facilitate the alignment of hair and support of the skin. As will be described in greater detail below, the spacing of multiple sets of spaced apart projections may be optimized for hair alignment and support the skin.

The second set of projections 36 may be positioned immediately in front of the blade 16 to channel hair to the blade 16. The first set of projections 34 may be positioned immediately behind the skin engaging member 14 (e.g., the skin-engaging protrusion 32) to facilitate the alignment of any hairs pressed down by the skin-engaging protrusion 32). In certain embodiments, first set of projections 34 and/or the second set of projections 36 may be arranged in a row parallel to the blade 16. The first and second set of spaced apart projections 34 and 36 may include a plurality of fingers 40*a* and 40*b* (respectively). The fingers 40*a* and 40*b* may have numerous cross sectional shapes, including, but not limited to circles, squares, half-circles, hexagons, pentagons, octagons, or ovals. The fingers 40*a* and 40*b* may be configured for the management of skin and may facilitate the alignment and guiding of hair to the blade 16, thereby providing for more efficient cutting of hairs. The fingers 40*a* and 40*b* may orient hair in an upward direction away from the skin surface and channel it to the blade 16. The fingers 40*a* and 40*b* may extend along the entire length of the guard bar 18, or they may extend along only certain sections of the guard bar 18, such as the middle or ends.

The first set of spaced apart projections 34 may be offset from the second set of spaced apart projections 36 in a first direction (e.g., laterally) and in a second direction (e.g., longitudinally) that is different than the first direction. The offset of the first and second set of projections 34 and 36 in two different directions may facilitate the release and passage of hair to the blade 16 and provide additional support to the skin for minimizing nicks and cuts. The first direction may be parallel to the blade 16 and the second direction may be transverse to the blade 16. The first and second set of projections 34 and 36 may be offset such that the fingers 40*a* and 40*b* do not overlap in either the first direction (e.g., laterally) or the second direction (e.g., longitudinally). For example, if the first and second set of projections 34 and 36 overlapped in the first direction, the first and second set of projections 34 and 36 may not support the skin sufficiently, which may result in increased nicks and cuts. Hairs that may become trapped under the first set of projections 34 may release because the second set of projections 36 are offset laterally from the first set of projections 34. If the fingers 40*a* and 40*b* overlapped in the second direction the passage of hair to the blade 16 may be obstructed.

In certain embodiments, the first and second set of projections 34 and 36 may each have about 15, 20, or 25 to about 30, 35, or 40 fingers 40*a* and 40*b*. The total number of fingers 40*a* and 40*b* may vary depending on the overall length guard bar 18 and the cartridge 30. The number of fingers 40*a* and 40*b* is based on a standard length cartridge 30 of about 35 mm to about 45 mm; however, the cartridge 30 may have a length less than about 35 mm or greater than about 45 mm. An increased number of fingers 40*a* and 40*b* may ensure that the skin is properly supported and as many hairs as possible are aligned in front of the blade 16 immediately behind the second set of projections 36.

Guards typically comprise an elastomeric material and/or have features that are intended to stretch the skin in front of the blade. The skin is stretched to minimize skin bulge, which results in nicks and cuts of the skin. However, these guards also have a propensity to trap and push hairs flat against the surface of the skin. The interaction of these guards with hair is analogous to rolling a weighted drum over grass just prior to cutting the grass with the blade of a lawn mower. Accordingly, the grass is pressed down and lays flat which results in the blade missing or skiving the grass. The grass, similar to hair on the skin, cannot be cut effectively and efficiently if it is not oriented generally perpendicular to the blade. Furthermore, these guards have a tendency to bunch hairs together in front of the blade 16, which also decreases the efficiency of the blade 16 to cut hair.

The first set of projections 34 may be spaced apart from the skin-engaging member 14 to define an elongated gap 38. In certain embodiments, the elongated gap 38 may extend continuously along the length of the guard bar 18 or the elongated gap 38 may include segments that extend in a discontinuous manner along the length of the guard bar 18. Without being held to theory, it is believed that providing the elongated gap 38 between the guard bar 18 and the skin-engaging member 14 (e.g., the skin engaging protrusion 32) facilitates release of hairs from the skin-engaging member 14 (e.g., the skin engaging protrusion 32). After the hairs are stretched and pushed down by the skin-engaging member 14, the hairs may extend and release into the elongated gap 38 before being aligned by the first and second sets of spaced apart projections 34 and 36. The skin-engaging member 14 (e.g., the skin engaging protrusion 32) may facilitate the alignment of hair by flicking the hair in a more upright position as the hair reaches the guard bar 18. The skin engaging protrusion 32 may work in combination with the longitudinal recess 38 to release and orient the hair in a more upward direction. The first and second sets of spaced apart projections 34 and 36 of the guard bar 18 may align and channel the hair toward the blade 16. Accordingly, the hair is presented to the blade 16 in a more upright position and is not bunched up, resulting in improved cutting effectiveness and consistency (e.g., fewer hairs are missed or not cut by the blade 16). The increased hardness of the guard bar 18 may provide for optimum alignment of hairs during shaving and the softer skin-engaging member 14 (e.g., the skin engaging protrusion 32) may provide optimum skin stretching and tactile feel.

Figure 3:
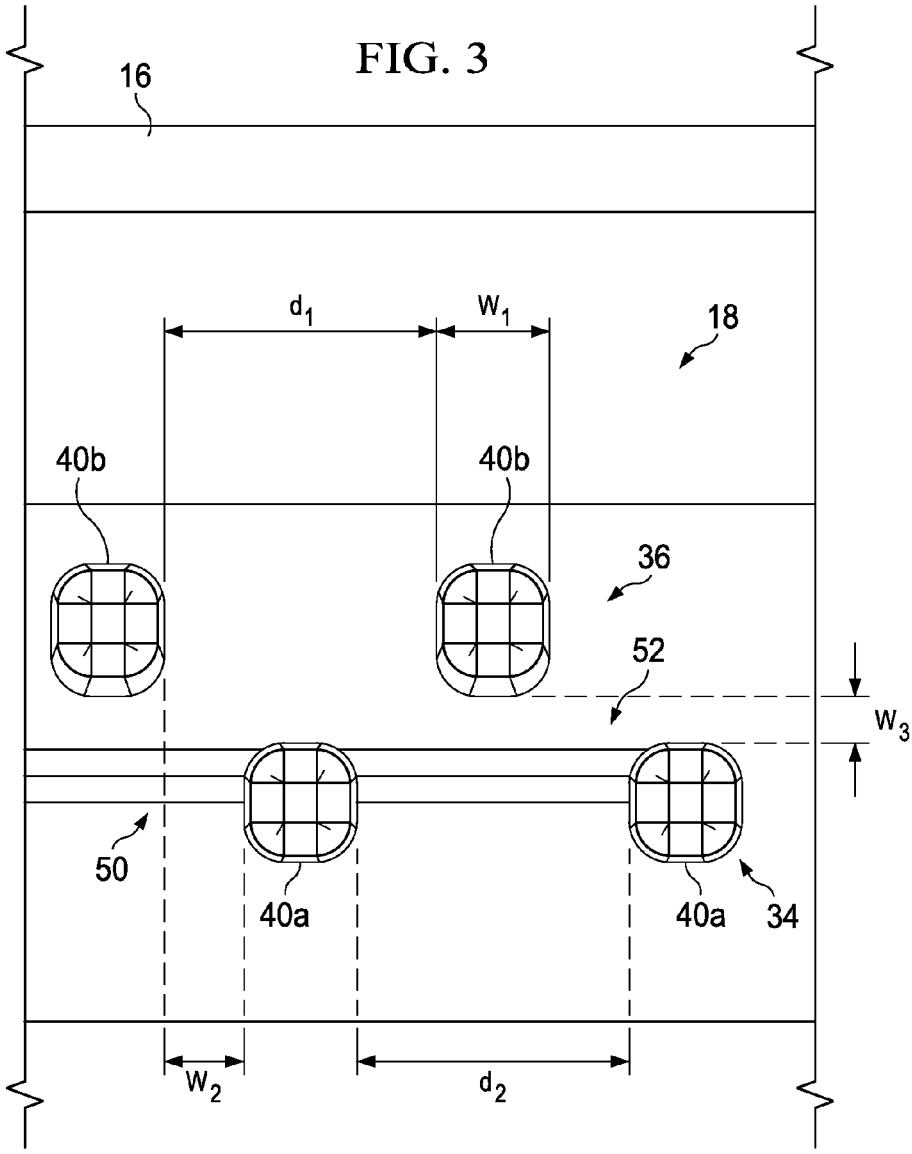
FIG. 3 is a partial top view of the shaving cartridge of FIG. 2.

Referring to FIG. 3, an enlarged top view of a portion 18*a* of the guard bar 18 is shown. The fingers 40*a* and 40*b* may have a width $w_1$ of about 0.2 mm or 0.3 mm to about 0.4 mm or 0.5 mm. The width $w_1$ may be measured from the top of the fingers 40*a* and 40*b* or at the base of the fingers 40*a* and 40*b*. In certain embodiments, the fingers 40*a* and 40*b* may have a draft angle of about 1 degree to about 5 degrees per side to facilitate the release of the fingers 40*a* and 40*b* from an injection mold during manufacturing. The width $w_1$ of the fingers 40*a* and 40*b* may provide sufficient comfort and support for the skin. For example, if the width $w_1$ is too small, the fingers 40*a* and 40*b* may press into the skin causing discomfort (e.g., scraping of the skin) during shaving. Alternatively, if the width $w_1$ is large, more hairs may become trapped under the fingers 40*a* and 40*b* which may increase the number of hairs properly presented to the blade 16.

Two or more adjacent fingers 40 may be spaced apart laterally from each other by a distance $d_1$ of about 0.6 mm, 0.8 mm, or 0.9 mm to about 1.0 mm, 1.25 mm, or 1.5 mm to provide an opening therebetween for hair to pass as well as provide sufficient support for the skin. The second set of spaced apart projections 36 may include two or more adjacent fingers 40*b* that are spaced apart from each other by a distance $d_2$ of about 0.6 mm, 0.8 mm, or 0.9 mm to about 1.0 mm, 1.25 mm, or 1.5 mm for providing an opening therebetween for hair to pass and sufficiently support the skin. Although only two sets of projections 34 and 36 are shown, more than two sets of offset projections 34 and 36 may be used. The spacing of multiple sets of offset projections may be calculated using the equation "$y=(2a\times b)-b$". In this equation, the variable "y" is the distance (e.g., $d_1$ or $d_2$) between fingers (e.g., 40*a*) within a single set of projections (e.g., 34), "a" is the number of sets of offset projections, and "b" is a constant having a value of about 0.20 mm, 0.25 mm, or 0.30 mm to about 0.35 mm, 0.40 mm, or 0.5 mm. For example, the value for "y" for three sets of offset projections with a "b" value of about 0.33 mm would be about 1.98 mm.

The first set of projections 34 and the second set of projection 36 may define a plurality of open channels 50 that extend transverse to the blade 16. The open channel 50 may have a width $w_2$ of about 0.2 mm, 0.25 mm, 0.3 mm to about 0.35 mm, 0.4 mm, or 0.5 mm to facilitate the alignment and channeling of hair. The width $w_2$ be the lateral distance between one of the fingers 40 of the first set of projections and one of the adjacent fingers 40*b* of the second set of projections 36. The width of a human hair is about 0.10 mm. If the width of open channels 50 is less than about 0.10 mm, then the hair may be caught up in the open channel 50 and prevent other hairs from properly passing through the open channel 50. Furthermore, if the width of the open channel 50 is too small it may hamper proper rinsing. Shaving aids, hair, dirt and debris may become trapped between the fingers 40*a* and 40*b*, thus decreasing the effectiveness of the open channel 50 to facilitate the alignment and channeling of hair. This may become even more critical for users that shave infrequently. Longer hairs would be even more likely to become trapped and difficult to rinse out, which may hamper the effectiveness of the blade 16 to cut hair. The longer hairs would also be more likely to trap additional hairs, shaving aids, dirt and debris. Furthermore, if the open channel 50 is too narrow, hair will not pass through the open channel 50, but will be gripped and pulled by the fingers 40*a* and 40*b*. The gripping and pulling of hair is very uncomfortable to the user and often results in hair becoming trapped in the open channel 50. The open channel 50 should be large enough not to influence comfort (e.g., pulling of hair) and facilitate the free passage of hair to the blade 16. The fingers 40*a* and 40*b* may be rigid such that the geometry of the open channel 50 remains consistent during normal shaving conditions, thus maintaining optimum blade-skin geometry resulting in a closer and more comfortable shave. In certain embodiments, the guard bar 18 may be of sufficient stiffness such that the fingers 40*a* and 40*b* do not bend or flex under normal shaving conditions, which may adversely influence the size of the channel 50 and decrease support of the skin.

The first set of projections 34 (e.g., the finger 40*a*) may be longitudinally spaced apart (i.e., offset) from the second set of projections 36 (e.g., finger 40*b*) by a width $w_3$. In certain embodiments, the width $w_3$ may be about 0.05 mm, 0.10 mm, or 0.15 mm to about 0.20 mm, 0.35 mm, or 0.50 mm. The width $w_3$ between the first set of projections 34 and the second set of projections 36 may provide support for the skin during shaving. For example, if $w_3$ is too large, skin may sag or bulge between the fingers 40*a* and 40*b*. Skin that is not adequately supported has a greater tendency to be cut or nicked by the blade 16, which results in discomfort. Furthermore, if the skin is not supported over a sufficiently large enough area, the fingers 40*a* and 40*b* may apply increased pressure on the skin. In certain embodiments, the fingers 40*a* and 40*b* may be arranged in a triangular pattern to minimize the exposure of skin to the blade 16 and provide improved skin support. The arrangement of the fingers 40*a* and 40*b* in a triangular pattern may support the skin over a larger surface. For example, at least one of the fingers 40*a* may be positioned in front of and between two fingers 40*b* of the second set of projections 36. The fingers 40*a* may be equally spaced apart from the two fingers 40*b*.

Figure 4:
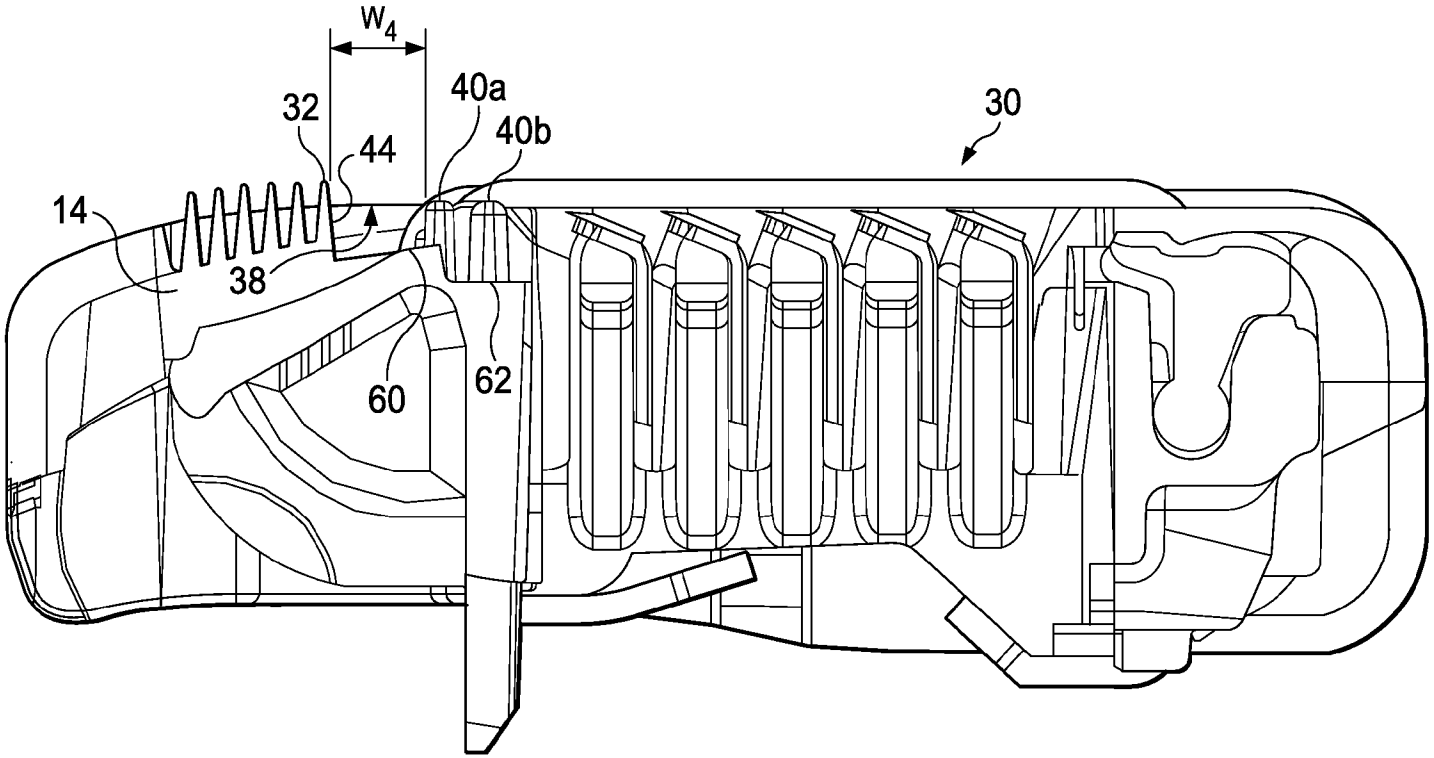
FIG. 4 is a cross sectional view of the cartridge of FIG. 2, taken generally along the line 4-4 of FIG. 2.

Referring to FIG. 4, a cross section view of the cartridge 30 is shown, taken generally along the line 4-4 of FIG. 2. In certain embodiments, the guard bar 18 may be stepped to facilitate alignment of hair. The guard bar 18 may have a first shoulder 60 between the skin engaging member 14 and the blade 16 and a second shoulder 62 between the first shoulder and the blade 16. The first shoulder 60 and the second shoulder 62 may extend along different plane (e.g., the first shoulder 60 may be positioned above the second shoulder 62). The first and second shoulders 60 and 62 may extend parallel to the blade 16. In certain embodiments, the first shoulder 60 may be inclined at an angle toward the blade 16. Without being held to theory, it is believed that providing the guard bar 18 with the first and second shoulders 60 and 62 may allow longer hairs passing from the skin engaging member 14 to extend more, thus improving alignment of the hairs in front of the blade 16. For example, any hairs that are bunched up and/or flat within the elongated gap 38 may be free to extend and become aligned before reaching the blade 16.

The fingers 40*a* and 40*b* may have a height as measured from at least one of the first and second shoulders 60 and 62 of about 0.3 mm, 0.4 mm, or 0.50 mm to about 1.0 mm, 1.5 mm, or 2.0 mm. In certain embodiments, the fingers 40*a* may project at least partially from the first shoulder 60 and/or the second shoulder 62 of the guard bar 18. The fingers 40*b* may project from the second shoulder 62. The finger 40*a* of the first set of projections 34 may be spaced apart from a rear face 44 of the skin-engaging member 14 (e.g., skin-engaging protrusion 32) to define the elongated gap 38. The elongated gap 38 may have a width "$w_4$" between the fingers 40 of the first set of projections 34 and the rear face 44 of the skin engaging member 14 (e.g., skin-engaging protrusion 32) of about 0.25 mm, 0.5 mm, or 0.75 mm to about 1.0 mm, 1.5 mm, or 2.0 mm. The width of the elongated gap 38 provides an open space for hairs to release from the skin-engaging member 14. The elongated gap 38 may be positioned on the same plane as the first shoulder 60.

Figure 5:
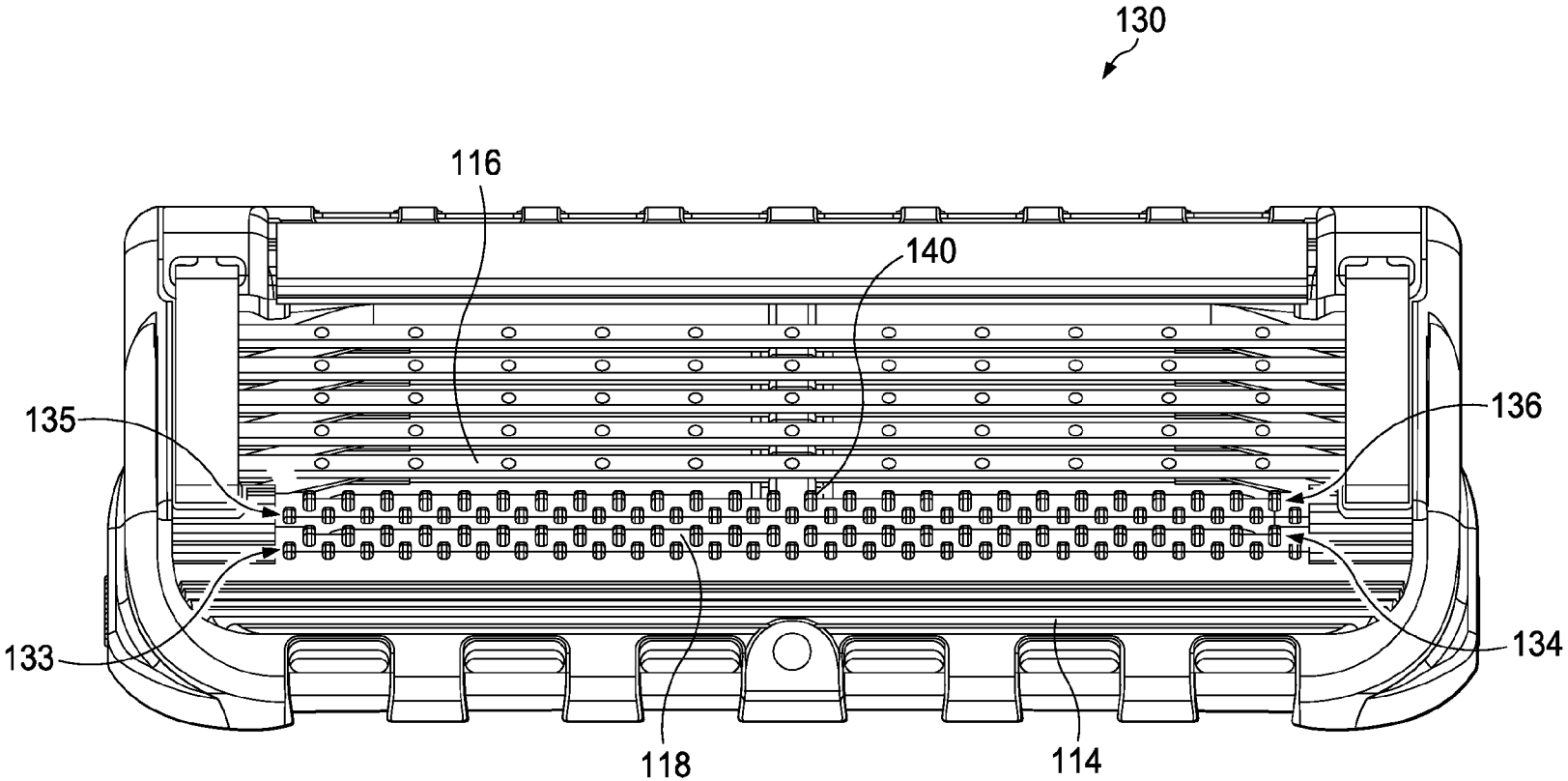
FIG. 5 is a front view of another possible embodiment of a shaving cartridge.

Referring to FIG. 5, another possible embodiment of a shaving cartridge 130 is shown. The shaving cartridge 130 may be the same as the shaving cartridge 30 as previously described, with the exception that the shaving cartridge 130 may have more than two sets of offset projections. For example, the shaving cartridge 130 may have a guard bar 118 with a first, second, third and fourth set of projections 133, 134, 135, and 136 between a blade 116 and a skin engaging member 114. The additional sets of projections may improve the support of the skin during shaving by providing additional fingers 140. Each of the set of projections 133, 134, 135, and 136 may be offset laterally and longitudinally from the adjacent set of projections 133, 134, 135, and 136, such that hair may be aligned in front of the blade. The spacing of the set of projections 133, 134, 135, and 136 and the fingers 140 may be the same as that previously described for the fingers 40*a* and 40*b* and the set of projections 34 and 36.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving system comprising:

a cap;

a skin-engaging member;

at least one blade between the skin engaging member and the cap; and a guard bar between the skin engaging member and the at least one blade, the guard bar having a first set of spaced apart projections offset from a second set of spaced apart projections in a first direction parallel to the at least one blade and in a second direction transverse to the at least one blade, the first set of projections and the second set of projections define a plurality of openings extending from the skin engaging member to the at least one blade to facilitate hair to pass from the skin engaging member to the blade, wherein the openings have a width of about 0.20 mm to about 0.50 mm and the projections maintain consistent geometry during a shaving stroke.

2. The shaving system of claim 1 wherein a rear face of the skin engaging member and the first set of projections define an elongated gap parallel to the at least one blade having a width of about 0.25 to about 2.0 mm.

3. The shaving system of claim 1 wherein the guard bar has a first and second shoulder each extending parallel to the at least one blade.

4. The shaving system of claim 1 wherein the openings have a width of about 0.25 mm to 0.4 mm.

5. The shaving system of claim 1 wherein a rear face of the skin engaging member and the first set of projections define an elongated gap parallel to the at least one blade and the skin-engaging member comprises a material having a Shore A hardness that is less than a Shore A hardness of the guard bar.

6. The shaving system of claim 5 wherein the skin-engaging member has at least one flexible skin-engaging protrusion.

7. The shaving system of claim 6 wherein the at least one flexible skin-engaging protrusion is a plurality of spaced apart fins.

8. The shaving system of claim 1 wherein the first and second set of projections are longitudinally spaced apart by a width of about 0.05 mm to about 0.50 mm.

9. The shaving system of claim 1 wherein the first and second set of projections are each arranged in a row that is parallel to the at least one blade.

10. The shaving system of claim 9 wherein the cap, the at least one blade and the guard bar are mounted to a housing.

11. The shaving system of claim 10 further comprising a handle pivotably mounted to the housing.

12. The shaving system of claim 1 further comprising a third set of spaced apart projections offset from at least one of the first and second set of spaced apart projections in the first direction parallel to the at least one blade and in the second direction transverse to the at least one blade.

13. A shaving cartridge comprising:

a housing having a cap and a guard bar;

at least one blade mounted to the housing between the cap and the guard bar;

a skin-engaging member mounted to the housing in front of the guard bar; and a plurality of fingers projecting from the guard bar, wherein the plurality of fingers are laterally spaced apart by a distance of about 0.6 mm to about 1.5 mm and are longitudinally spaced apart by a distance of about 0.05 mm to about 0.50 mm, wherein the plurality of fingers define a plurality of openings extending from the skin engaging member to the at least one blade to facilitate hair to pass from the skin engaging member to the blade and wherein the fingers maintain consistent geometry during a shaving stroke.

14. The shaving system of claim 13 wherein the guard bar is stepped.

15. The shaving cartridge of claim 13 wherein the openings have a width of about 0.20 mm to about 0.50 mm.

16. The shaving system of claim 13 wherein the plurality of fingers that are adjacent the skin engaging member and the skin engaging member define an elongated gap parallel to the at least one blade having a width of about 0.25 to about 2.0 mm.

17. The shaving system of claim 13 wherein the skin-engaging member comprises a material having a Shore A hardness that is less than a Shore A hardness of the fingers.

18. The shaving cartridge system of claim 17 wherein the skin-engaging member has at least one flexible skin-engaging protrusion.

* * * * *